US005927293A

United States Patent [19]

Halpern

[11] Patent Number: 5,927,293

[45] Date of Patent: Jul. 27, 1999

[54] METHOD FOR MAKING MULTI-COLORED ARTIFICIAL FINGERNAILS

[75] Inventor: Lin Halpern, Jenkintown, Pa.

[73] Assignee: American Consolidated Mfg. Co., Inc., West Conshohocken, Pa.

[21] Appl. No.: 08/966,990

[22] Filed: Nov. 10, 1997

[51] Int. Cl.[6] ..... A45D 29/06

[52] U.S. Cl. ..... 132/200; 132/73; 132/285

[58] Field of Search ..... 132/200, 73, 285

[56] References Cited

U.S. PATENT DOCUMENTS

| | | | |
|---|---|---|---|
| 2,162,155 | 6/1939 | Calvin | 132/73 |
| 2,234,657 | 3/1941 | Smaldone | 132/73 |
| 2,239,040 | 4/1941 | Holmes | 132/73 |
| 2,670,745 | 3/1954 | Lui | 132/285 |
| 2,799,282 | 7/1957 | Slack | 132/285 |
| 4,690,369 | 9/1987 | Giuliano | 132/73 |
| 5,005,595 | 4/1991 | Aylott | 132/73 |
| 5,044,384 | 9/1991 | Hokama et al. | 132/73 |
| 5,127,414 | 7/1992 | Mast et al. | 132/73 |

*Primary Examiner*—Todd E. Manahan
*Attorney, Agent, or Firm*—William H. Eilberg

[57] ABSTRACT

An artificial nail tip facilitates the creation of "French" nails. The nail tip includes a dam which divides the surface of the nail into two regions. By applying acrylic materials of different colors to the two regions, filling the regions up against the dam, one creates a nail having more than one color, and having a well-defined boundary between regions of different color. In another embodiment, the dam is affixed directly to the fingernail, and some of the acrylic material is applied to a temporary form that is attached to the fingernail. As in the first embodiment, two differently-colored acrylic materials are applied to different regions, up to the dam, to create a "French" nail. The present invention makes it possible to create "French" nails without the need for extensive training or talent, since the dam provides a guide for the application of the differently-colored acrylics.

12 Claims, 5 Drawing Sheets

METHOD FOR MAKING MULTI-COLORED ARTIFICIAL FINGERNAILS

BACKGROUND OF THE INVENTION

This invention relates to the field of cosmetics, and provides a method and apparatus for making artificial fingernails.

It has long been common for women to color their fingernails, and/or to wear artificial fingernails having various colors. Typically, such artificial fingernails have a length which greatly exceeds the maximum practical length of a natural nail. Artificial fingernails are generally formed of an acrylic material which is applied in a liquid or paste form, and then dried and hardened. The acrylic material may be applied, in part, over the surface of a natural nail, and/or it may be applied, in part, over a surface defined by a temporary nail form. Such nail forms, which may be made of paper or foil, are temporarily affixed to the finger, and the acrylic is applied to the form. After the acrylic has dried and hardened, the form can be removed, leaving an artificial nail extension defined by the acrylic.

In recent years, the "French" nail has become very popular. A French nail is an artificial fingernail having at least two colors. In its most common form, a French nail has a pink portion located at the proximal end of the nail (i.e. the end which is closer to the finger) and a white portion located at the distal end of the nail (i.e. the end which is farther away from the finger). The combination of pink and white generally imitates the ordinary coloring of a natural nail, which has a pink portion at the proximal end and a white (or, more accurately, non-colored) portion at the distal end.

The major problem with French nails is the difficulty in making them. It is very difficult for an untrained person to paint two different colors of acrylic onto a nail, while maintaining a well-defined border between the areas of different colors. It is also very difficult to perform the above while maintaining a desired thickness of the acrylic layer. Even professional nail technicians have difficulty making French nails, and the process can be tedious and therefore expensive.

The present invention solves the problems described above, and provides an apparatus and method for making French nails. The present invention greatly simplifies the procedure for making such nails, and enables nail technicians, or even relatively untrained persons, to form French nails very easily, while still insuring that the final product has a professional appearance.

SUMMARY OF THE INVENTION

In one preferred embodiment, the present invention includes a method of making a French nail, comprising the following steps. First, one affixes a specially-formed nail tip to a natural fingernail. The nail tip has a dam which extends across its width, so that the dam defines two regions above the nail. Next, one applies an acrylic or other material for forming an artificial nail onto one of the regions. Then, one applies an acrylic, or other material, having a different color, onto the other of the regions. The acrylic materials on the two regions are dried and hardened, and one then files them down, so that the boundary between regions is smooth. The filing may include filing down a portion of the dam separating the regions from each other. The result is a French nail having a well-defined boundary between the regions of different colors, and which has a smooth surface. The nail tip, which was originally affixed to the natural fingernail remains permanently in place.

The present invention also includes the nail tip described above, which nail tip includes the dam. The nail tip has a width and a curvature which correspond to those of the wearer, so that the nail tip, when affixed to the fingernail, comprises an extension of the natural fingernail.

In another preferred embodiment of the invention, one uses a temporary form as the substrate on which part of the artificial nail, normally the distal end, is created. In this embodiment, one affixes to the fingernail a device which defines a dam. But in this case, the dam is not part of an extended structure as in the first embodiment. Instead, the temporary form, affixed to the fingernail, defines a surface on which the acrylic material can be applied to create the distal end of the artificial nail. The dam still forms two regions above the fingernail, similar to those of the first embodiment. One region is located upon the temporary form and the other region is located upon the natural finger. As before, one applies acrylic material, or its equivalent, to the two regions, the materials applied to the two regions having different colors. After the acrylic materials are dried and hardened, they can be filed down as before. The temporary form can be removed at any time after the acrylic material applied to the form has hardened. The device defining the dam has a handle portion which is severed, leaving only the dam in place, after the dam has been glued to the fingernail.

The invention therefore also includes the device defining the dam, which device is used in the second embodiment described above. The dam has a width and curvature corresponding to those of the wearer's natural fingernail. The dam also has a handle, as described above. Preferably, the handle is connected to the dam by a relatively narrow neck which facilitates the removal of the handle, after the dam has been affixed to the fingernail.

The present invention therefore has the primary object of providing a method of making a decorated artificial fingernail, wherein the artificial fingernail has multiple colors.

The invention has the further object of making it easy to create a French nail.

The invention has the further object of enabling relatively unskilled persons to make artificial fingernails having multiple colors.

The invention has the further object of enhancing the quality, and reducing the cost, of French nails.

The invention has the further object of providing devices for use in methods which enable the rapid and easy creation of French nails.

The reader skilled in the art will recognize other objects and advantages of the present invention, from the following brief description of the drawings, the detailed description of the invention, and the appended claims.

DETAILED DESCRIPTION OF THE INVENTION

Figure 1:
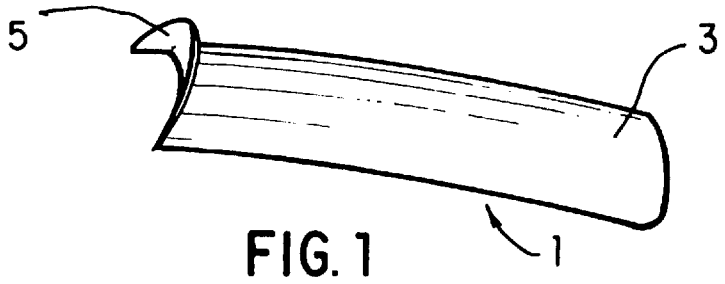
FIG. 1 provides a perspective view of a nail tip made according to a first preferred embodiment of the present invention.

FIG. 1 provides a perspective view of a nail tip made according to a first embodiment of the present invention, and FIGS. 2–10 illustrate the major steps of the method corresponding to this first embodiment. FIG. 1 shows nail tip 1, which includes an elongated body 3 and dam 5, the dam being disposed at one end of the body. As shown in the figure, the body is shaped to correspond generally to the shape of a fingernail, so that the body can eventually function as an extension of the natural fingernail. As also shown in the figure, the body is curved laterally to match generally the curvature of a natural fingernail. The dam extends across substantially the entire width of the body of the nail tip.

The nail tip of FIG. 1 is used according to the following method, illustrated in FIGS. 2–10.

As a preliminary step, it is preferable to roughen the surface of the natural nail, so as to remove any residual nail polish that may be on the nail, and to remove the natural waxy surface of the nail. The latter step improves the adhesion between the nail tip of the present invention and the natural nail.

Figure 2:
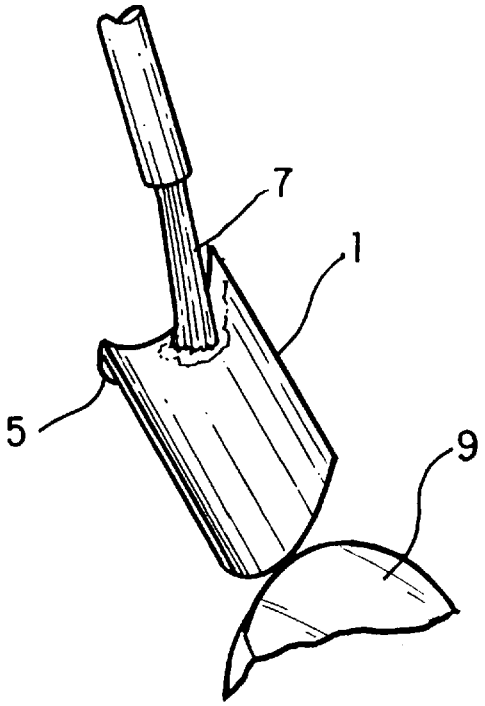
FIG. 2 provides a perspective view of the nail tip of FIG. 1, showing an adhesive being applied to the nail tip so as to affix it to a finger.

Next, as shown in FIG. 2, one applies an adhesive to the underside of nail tip 1, preferably by using a brush 7. The adhesive could also be applied with a utensil other than a brush, within the scope of the invention. FIG. 2 shows the adhesive being applied immediately before the nail tip is to be affixed to finger 9. Note that dam 5 is barely visible in FIG. 2, as it is directed away from the viewer.

Figure 3:
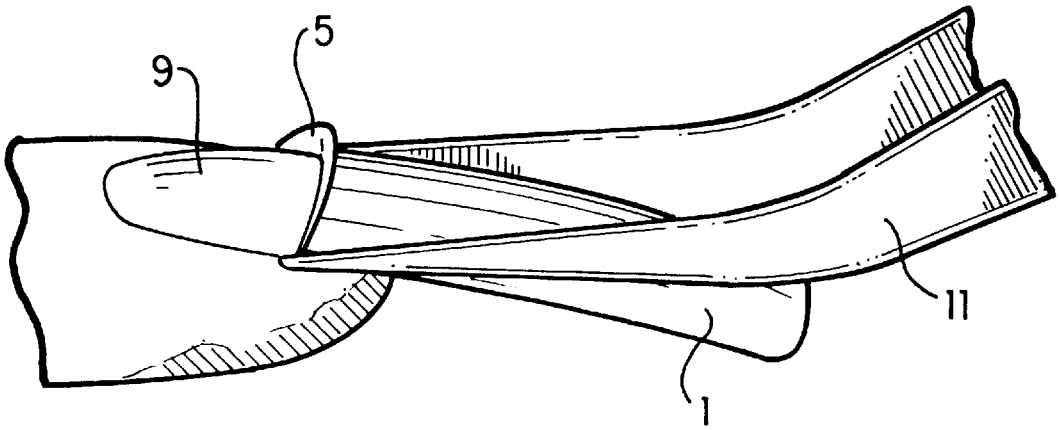
FIG. 3 provides a perspective view showing the attachment of the nail tip of the present invention to a finger.

The nail tip is then affixed to the natural nail by firmly bonding the nail tip to the nail, as shown in FIG. 3. This step is preferably performed with tweezers 11, or by any other tool which can be used to apply sufficient pressure to secure the nail tip to the fingernail. The nail tip now comprises a virtual extension of the natural nail. If one now considers the nail to include the extension, one can see that the dam divides the surface of the nail into two regions. The outermost region is called the distal region, and the innermost region (the region closer to the finger) is called the proximal region.

Figure 4:
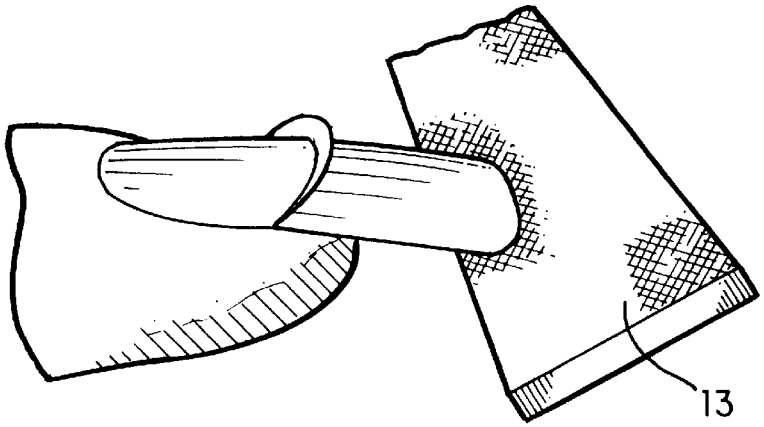
FIG. 4 provides a perspective view showing the filing down of the nail tip of the present invention.

FIG. 4 shows the use of file 13 to reduce the length of the nail tip, and to shape the nail tip, as desired. Other tools could be used in this step, and the invention is not limited by which tool is chosen.

Figure 5:
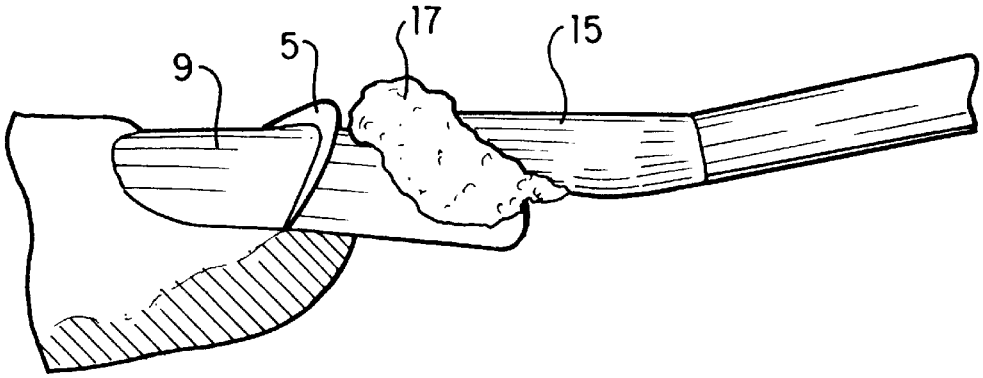
FIG. 5 provides a perspective view showing the application of an acrylic material to the distal region of the nail tip of the present invention.
Figure 6:
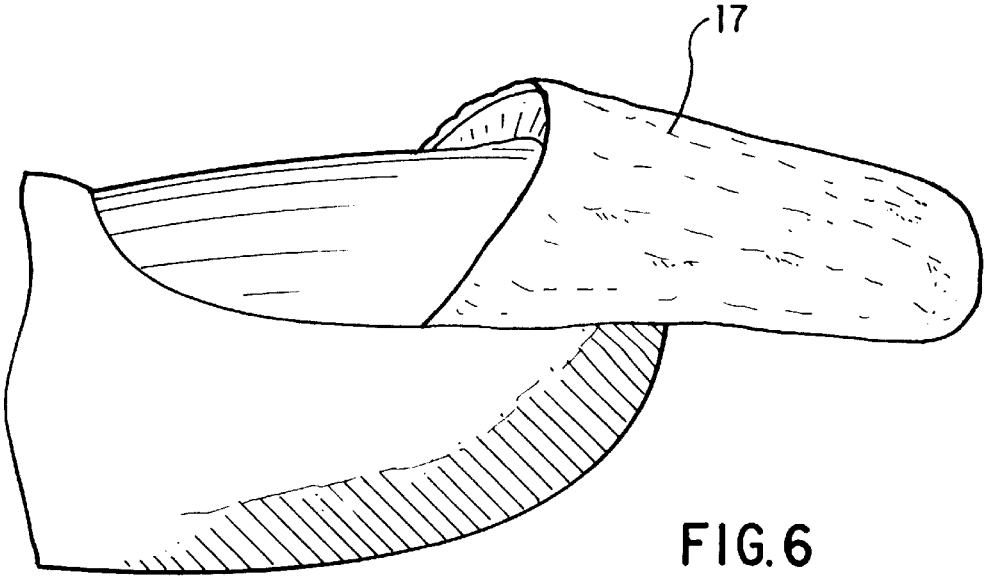
FIG. 6 provides a perspective view showing the nail tip of the present invention, wherein the entire distal region has been filled in with acrylic material.

In the next step, one applies an acrylic material to the distal region of the nail, as shown in FIG. 5. In this figure, brush 15 is shown applying acrylic material 17 to the distal region of the nail. The acrylic is applied in a manner such that the entire distal region is filled with acrylic, with the acrylic material abutting the dam 5. When the distal region has been completely filled with the acrylic material, the nail tip appears as shown in FIG. 6.

Figure 7:
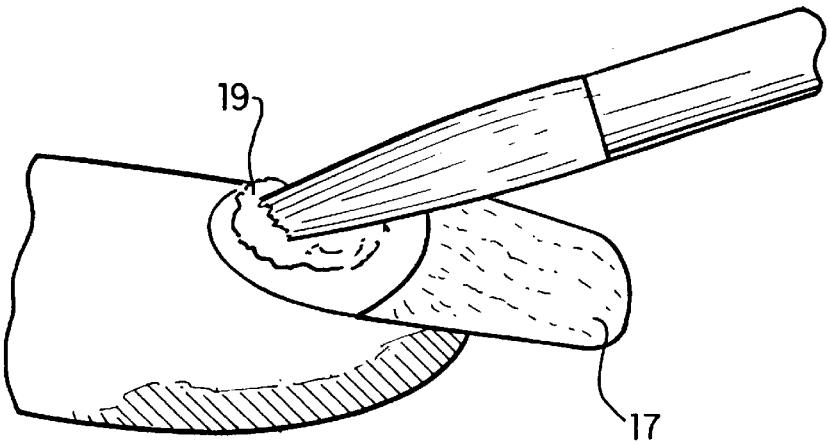
FIG. 7 provides a perspective view, showing the application of an acrylic material to the proximal region of the nail tip of the present invention.

Next, one applies an acrylic material to the proximal region of the nail, as shown in FIG. 7. The acrylic material applied to the proximal region is designated by reference numeral 19. The acrylic materials in the two regions have different reference numerals to emphasize that they have different colors. Acrylic material 19 is applied to the entire proximal region, up to the dam.

Figure 8:
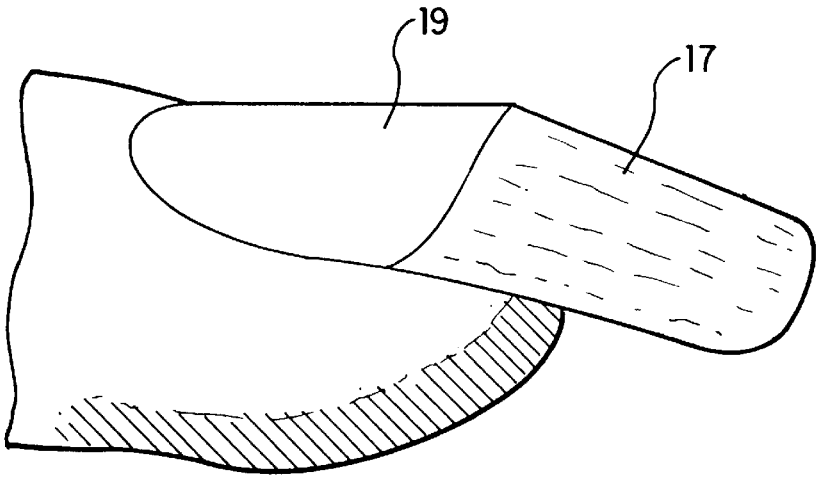
FIG. 8 provides a perspective view showing the nail tip of the present invention after both the distal and proximal regions have been filled in with acrylic material.
Figure 9:
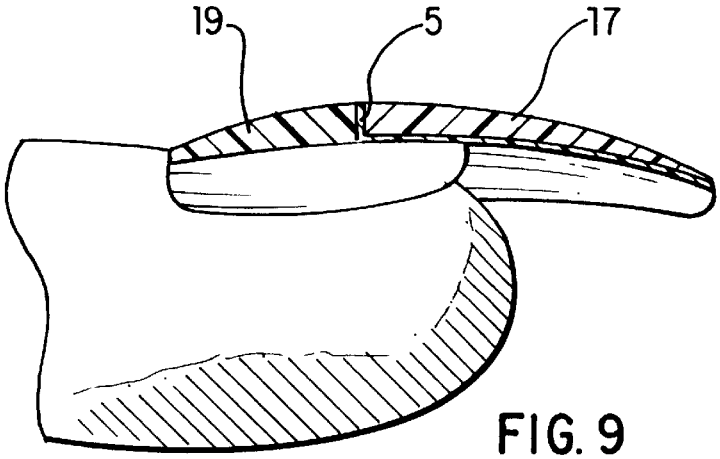
FIG. 9 provides a cross-sectional view of the nail tip of FIG. 8, showing the position of the dam after the acrylic material has been applied to both regions of the nail.
Figure 10:
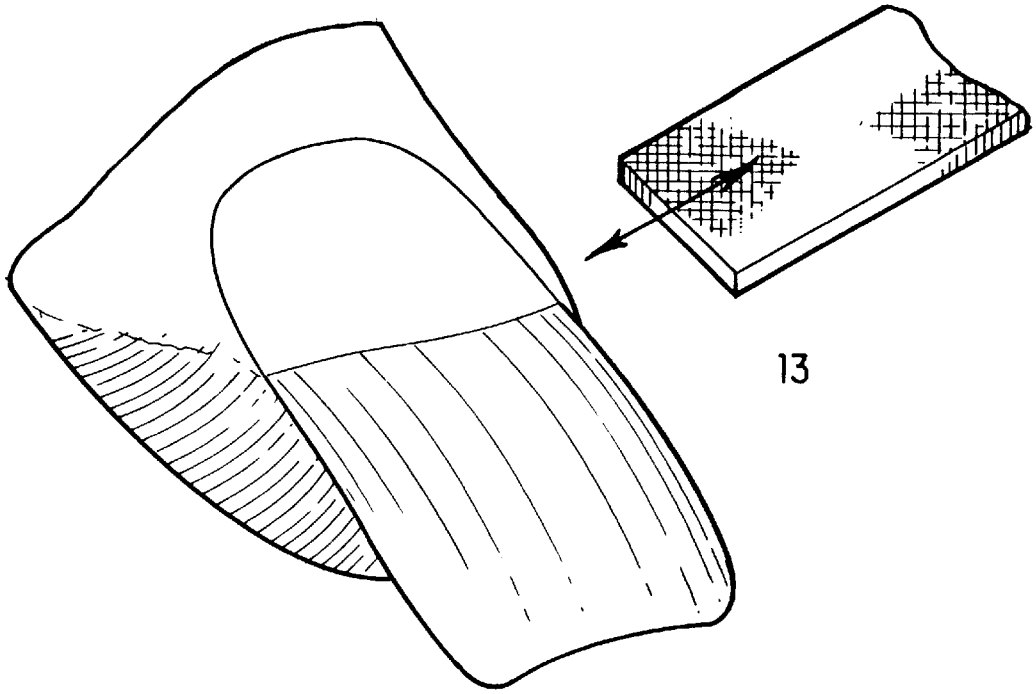
FIG. 10 provides a perspective view showing the application of a file to file down some of the acrylic and part of the dam, to produce the final result of the present invention.

When the application of acrylic materials 17 and 19 is complete, the nail appears as shown in FIG. 8. FIG. 9 shows a cross-sectional view of the same structure, wherein one can see dam 5 sandwiched between acrylic materials 17 and 19. For clarity of illustration, FIG. 9 shows only the fingernail in cross-section, the finger itself being shown in full. At this point, the acrylic materials are dried and hardened by conventional means, i.e. by volatilization or evaporation, by chemical action, by exposure to ultraviolet light, or by any combination of the foregoing. Alternatively, the first acrylic to be applied can be dried and hardened immediately after application, and the second acrylic can be dried and hardened later.

As indicated in FIGS. 8 and 9, the acrylic materials are applied in such a manner that the surface of the acrylics is bowed. This effect is due to the fact that the dam is intentionally made slightly higher than it should be in the final nail. Thus, the person applying the acrylics will be guided by the dam, and therefore will apply acrylic material, layer by layer, until the thickness of the acrylic material equals the full height of the dam. Therefore, after the acrylic materials have been dried and hardened, one should file the surface down, as symbolically indicated by FIG. 10. The filing reduces the thickness of both acrylic materials, in the vicinity of the dam, and also files away part of the dam itself. The result is a smooth surface, with a virtually perfect transition from one color of acrylic to the other. In short, one has produced a French nail without the need for special artistic talent.

In another alternative, the acrylic material is applied so that its thickness is less than the height of the dam. In this case, part of the dam is still filed down, so that the resulting nail has the desired smooth transitions.

FIGS. 11–14 illustrate a second embodiment of the present invention. In this embodiment, the dam is provided by the device shown in FIG. 12, and is not a part of a nail tip or extension. Instead, one uses a temporary form as a surface on which to build the distal portion of the nail.

Figure 11:
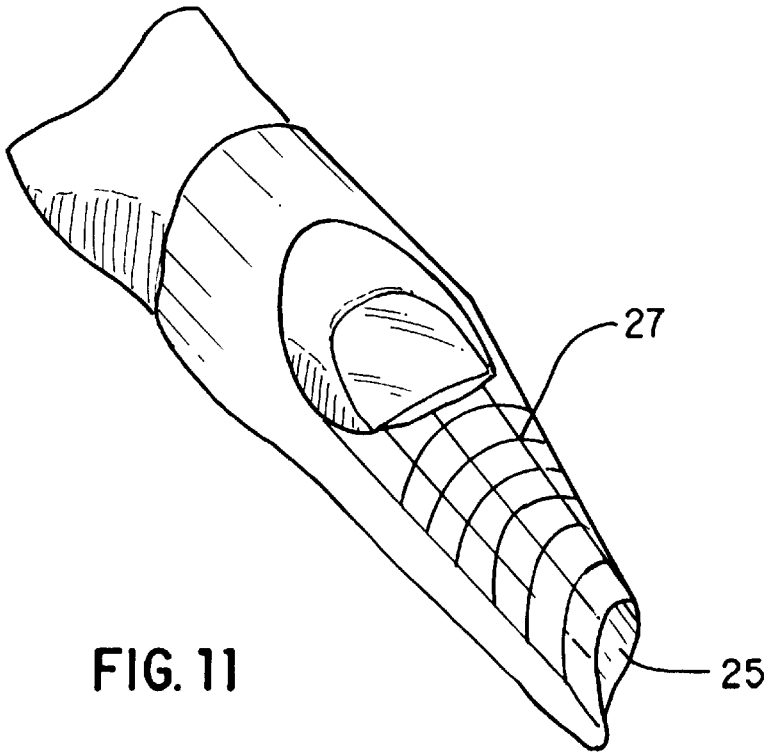
FIG. 11 provides a perspective view showing the attachment of a temporary form to a finger, in preparation for use of a second preferred embodiment of the present invention.

FIG. 11 shows a flexible nail form 25, which can be made of paper or other flexible material. The nail form is identical to a conventional nail form used in the art, though it is used in a somewhat different manner in the present invention. The nail form may be provided with a printed grid 27 which indicates distances, and serves as a guide for application of acrylic material to the distal region. The nail form is temporarily adhered to the finger. As shown in FIG. 11, when affixed to the finger, the nail form defines an aperture which exposes the natural nail.

Figure 12:
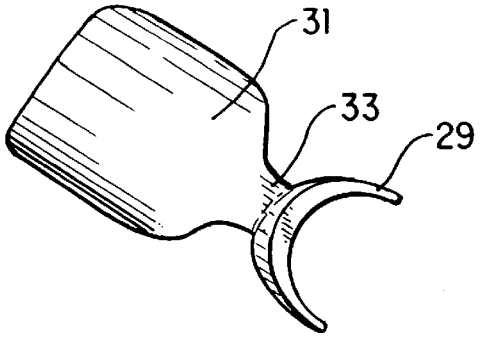
FIG. 12 provides a perspective view of a device used in the second preferred embodiment of the present invention.
Figure 13:
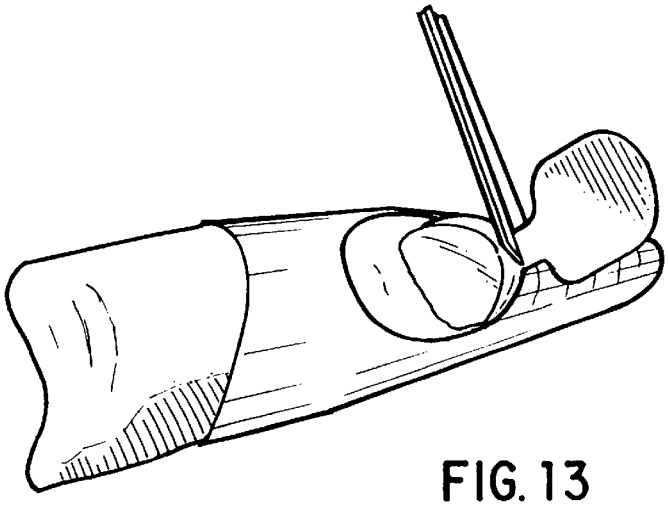
FIG. 13 provides a perspective view, showing the affixation of the device of FIG. 12 to a finger.

The device of this second embodiment of the present invention is shown in FIG. 12. The device includes dam 29, which is substantially identical to the dam formed on the nail tip of the first embodiment. The dam is attached to handle 31 by relatively narrow neck 33. FIG. 13 shows the affixation of the dam to the finger. The affixation is done with the aid of an adhesive which is not explicitly shown in the figure, but which is equivalent to that used in the first embodiment. After the dam has been affixed, the handle can be removed by cutting the handle off, or by snapping the handle off of the dam. FIG. 13 shows the handle being cut off. Note that the dam now defines distal and proximal regions, as in the first embodiment, except that the surface of the distal region is now defined by the nail form and not by an artificial nail tip. As in the first embodiment, the dam extends across substantially the entire fingernail.

Figure 14:
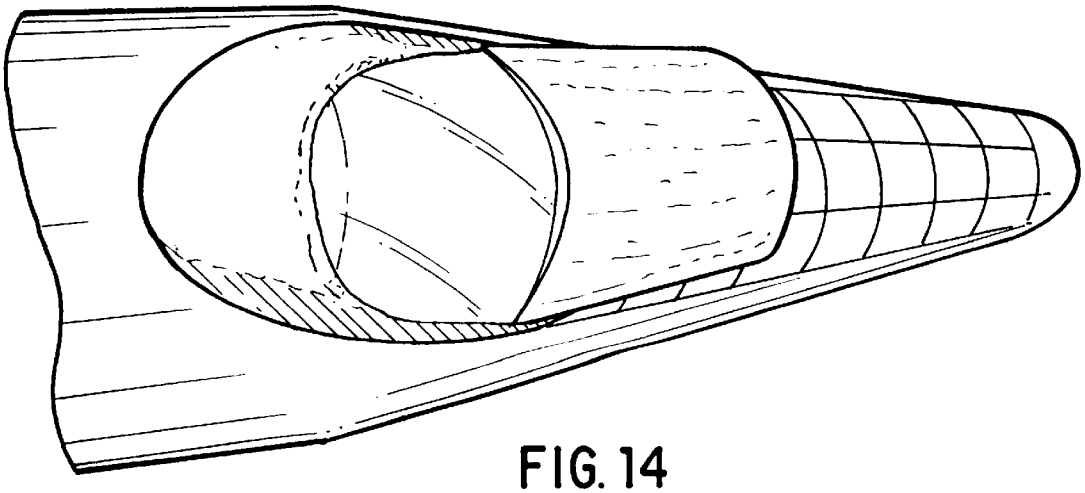
FIG. 14 provides a perspective view showing the device of FIG. 12, after an acrylic material has been applied to the distal region of the nail, according to the present invention.

Next, one applies an acrylic material to the distal region, as shown in FIG. 14. The acrylic is applied across the entire region, extending all the way to the dam, as in the first embodiment. Also as in the first embodiment, one can apply the acrylic in a thickness which is less than the height of the dam. As shown in FIG. 14, at least part of the acrylic material is applied directly onto the nail form. Then, another acrylic (not shown) is applied to the proximal region, which, as in the first embodiment, is located directly over the natural nail. The latter step is not shown because it is substantially identical to that shown with respect to the first embodiment.

The temporary nail form can be removed after the acrylic in the distal region is dried and hardened. The preferable technique, however, is to wait until both regions are filled with acrylic, and the acrylics have hardened, before removing the temporary form.

The step of filing the acrylic materials and the dam is identical to that described for the first embodiment.

Thus, the major difference between the first and second embodiments is that in the first embodiment, the dam is included with a nail tip which provides a surface on which the distal region is located. In the second embodiment, the dam is essentially an isolated structure, the distal surface being provided by the temporary nail form. But both embodiments use the same concept, namely that of a dam which separates two regions, to facilitate the application of different colors of acrylic to the two regions.

It is therefore apparent that the present invention enables a person lacking special skill to create virtually perfect French nails. With the present invention, it is not necessary to form the boundary between the acrylic materials by hand. Instead, the user need only fill the two regions with acrylic, up against the dam. The dam prevents acrylic from spilling over into an unintended region. Later, when the acrylic layers and the dam are filed down, the surface of the acrylic layers is smooth and shaped as desired, and the boundary between the acrylic layers is sharp and clear.

The acrylic material used to form the artificial nails is the same as any such material used in the prior art. The present invention is not limited according to such material. Similarly, any suitable adhesives can be used to adhere the dam to the natural nail.

The preferred material used to make the nail tip or dam is the material disclosed in U.S. Pat. No. 5,632,973 and U.S. patent application Ser. No. 08/710,491, the disclosures of which are hereby incorporated by reference herein. However, the invention is not limited to use with these materials, as any other material which is reasonably rigid, and which can be formed into the desired shape, can be used.

The invention could be generalized by providing more than one dam, to define more than two regions above the surface of a nail. Thus, it is possible to provide artificial nails having more than two colors, again without the need for exercising artistic talent. As long as the dams define the desired regions, one need only fill each region with acrylic, and file the surface down as described above.

The invention can be modified in many other ways, within the scope of the above disclosure. Many of the preparatory steps can be varied and/or omitted. The dimensions of the nail tip can be varied to suit the needs of particular users. The materials used as adhesives, acrylics, and for the dam itself, can be changed. The order of application of the acrylic material can be reversed; one could apply apply the acrylic to the proximal region first, and then to the distal region. These and other modifications which will be apparent to those skilled in the art should be considered within the spirit and scope of the following claims.

What is claimed is:

1. A method of forming a decorated fingernail, the method comprising the steps of:

a) affixing a nail tip to a fingernail, the nail tip having an elongated body shaped to define an extension of the fingernail, the nail tip also comprising a dam which extends across a width of the body, wherein the dam defines a plurality of regions, b) applying an artificial nail forming material to one of said regions, and c) applying an artificial nail forming material to another of said regions.

2. The method of claim 1, wherein the artificial nail forming materials of steps (b) and (c) have different colors.

3. The method of claim 1, further comprising the steps of drying the artificial nail forming materials applied in steps (b) and (c), and filing the artificial nail forming materials to form a smooth boundary between said regions.

4. The method of claim 3, wherein the filing step includes filing at least a portion of the dam.

5. The method of claim 1, wherein the dam defines a distal region and a proximal region, and wherein step (b) comprises applying the nail forming material to the distal region, and step (c) comprises applying the nail forming material to the proximal region.

6. The method of claim 1, wherein the dam defines a distal region and a proximal region, and wherein step (b) comprises applying the nail forming material to the proximal region, and step (c) comprises applying the nail forming material to the distal region.

7. A method of forming a decorated fingernail, the method comprising the steps of:

a) affixing a dam to a fingernail, the dam extending across a width of the fingernail, wherein the dam defines a plurality of regions above the fingernail, b) temporarily affixing a form to the fingernail, the form defining at least one surface capable of receiving a material for forming an artificial nail, c) applying an artificial nail forming material to one of said regions, d) applying an artificial nail forming material to another of said regions, and e) removing the form.

8. The method of claim 7, wherein the artificial nail forming materials of steps (c) and (d) have different colors.

9. The method of claim 7, further comprising the steps of drying the artificial nail forming materials applied in steps (c) and (d), and filing the artificial nail forming materials to form a smooth boundary between said regions.

10. The method of claim 9, wherein the filing step includes filing at least a portion of the dam.

11. The method of claim 7, wherein the dam defines a distal region and a proximal region, and wherein step (c) comprises applying the nail forming material to the distal region, and step (d) comprises applying the nail forming material to the proximal region.

12. The method of claim 7, wherein the dam defines a distal region and a proximal region, and wherein step (c) comprises applying the nail forming material to the proximal region, and step (d) comprises applying the nail forming material to the distal region.

* * * * *